US010923834B1

(12) United States Patent
De Cloet et al.

(10) Patent No.: US 10,923,834 B1
(45) Date of Patent: Feb. 16, 2021

(54) INTERMEDIATE PRODUCT AND METHOD FOR CRIMPING AN ELECTRICAL CONDUCTOR

(71) Applicant: TE Connectivity Germany GmbH, Bensheim (DE)

(72) Inventors: Olivier De Cloet, Lorsch (DE); Christian Schrettlinger, Bensheim-Auerbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/945,535

(22) Filed: Jul. 31, 2020

(30) Foreign Application Priority Data

Jul. 31, 2019 (DE) ..... 102019211473.3

(51) Int. Cl.

| | |
|---|---|
| ***H01R 4/20*** | (2006.01) |
| ***H01B 11/00*** | (2006.01) |
| ***H01R 43/048*** | (2006.01) |
| ***H01R 13/6591*** | (2011.01) |
| ***H01R 43/02*** | (2006.01) |

(52) U.S. Cl.
CPC ..... *H01R 4/20* (2013.01); *H01B 11/00* (2013.01); *H01R 13/65912* (2020.08); *H01R 43/0207* (2013.01); *H01R 43/048* (2013.01)

(58) Field of Classification Search
CPC H01R 4/20; H01R 13/65912; H01R 43/0207; H01R 43/048; H01B 11/00
USPC ..... 174/84 C
See application file for complete search history.

(56) References Cited

U.S. PATENT DOCUMENTS 2,769,965 A * 11/1956 Frey ..... H01R 4/20 439/730
2,904,619 A * 9/1959 Forney, Jr. ..... H01R 4/20 174/88 R
3,067,489 A * 12/1962 Hoffman ..... H01R 4/20 29/862
3,216,091 A * 11/1965 Floyd, Jr. ..... H01R 43/058 29/863
3,453,377 A * 7/1969 Gillespie ..... H01R 9/0512 174/75 C
3,519,729 A * 7/1970 La Van ..... H01R 9/0518 174/88 R
4,272,150 A * 6/1981 Fairbairn ..... H01R 13/33 439/879

(Continued)

FOREIGN PATENT DOCUMENTS

DE 10218399 A1 12/2002
DE 10354950 A1 6/2004

(Continued)

OTHER PUBLICATIONS

Translation of JP2014164868, dated Sep. 8, 2014, 16 pages.
Extended European Search Report, dated Oct. 2, 2020, 10 pages.

*Primary Examiner* — Timothy J Thompson
*Assistant Examiner* — Michael F McAllister
(74) *Attorney, Agent, or Firm* — Barley Snyder

(57) ABSTRACT

An intermediate product for crimping includes an electrical conductor extending along a longitudinal axis. The electrical conductor has a shielding braid and an insulation at least partially enclosing the shielding braid. The electrical conductor has a radially compressed core in a region along the longitudinal axis.

14 Claims, 1 Drawing Sheet

(56) References Cited

U.S. PATENT DOCUMENTS

| | | | | |
|---|---|---|---|---|
| 4,365,412 | A * | 12/1982 | Marsh | H01R 13/025 29/857 |
| 6,107,572 | A | 8/2000 | Miyazaki | |
| 6,119,320 | A | 9/2000 | Weiss | |
| 2013/0199841 | A1* | 8/2013 | Lehmann | H02G 1/14 174/75 R |
| 2015/0075863 | A1 | 3/2015 | Suso | |
| 2017/0178769 | A1 | 6/2017 | Denerf et al. | |
| 2018/0366851 | A1* | 12/2018 | Garcia et al. | |
| 2019/0058312 | A1 | 2/2019 | Meinhold et al. | |

FOREIGN PATENT DOCUMENTS

| | | | |
|---|---|---|---|
| DE | 102008021747 | A1 | 11/2009 |
| EP | 2544316 | A1 | 1/2013 |
| JP | 2014011133 | A | 1/2014 |
| JP | 2014164868 | A | 9/2014 |

* cited by examiner

INTERMEDIATE PRODUCT AND METHOD FOR CRIMPING AN ELECTRICAL CONDUCTOR

CROSS-REFERENCE TO RELATED APPLICATION

This application claims the benefit of the filing date under 35 U.S.C. § 119(a)-(d) of German Patent Application No. 102019211473.3, filed on Jul. 31, 2019.

FIELD OF THE INVENTION

The present invention relates to crimping an electrical conductor and, more particularly, to an intermediate product for crimping an electrical conductor.

BACKGROUND

In order to terminate an electrical conductor, contacts with a crimp connection, for example a crimp sleeve, are laid around the electrical conductor and compressed with the crimp connection. As a result, a mechanically and electrically stable connection is produced between the contact and the conductor.

The electrical conductors are manufactured with a certain tolerance, which results in irregularities arising in the diameter of the conductor. Furthermore, electrical conductors with slight differences in diameter can be found on the market. In particular in the case of crimping, in practice this leads to waste, for example, if single strands of a shielding braid protrude radially out of the crimp seam of an e.g. slotted, open crimp sleeve, such that this results in an excessively high degree of waste during production of a crimped conductor.

SUMMARY

An intermediate product for crimping includes an electrical conductor extending along a longitudinal axis. The electrical conductor has a shielding braid and an insulation at least partially enclosing the shielding braid. The electrical conductor has a radially compressed core in a region along the longitudinal axis.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
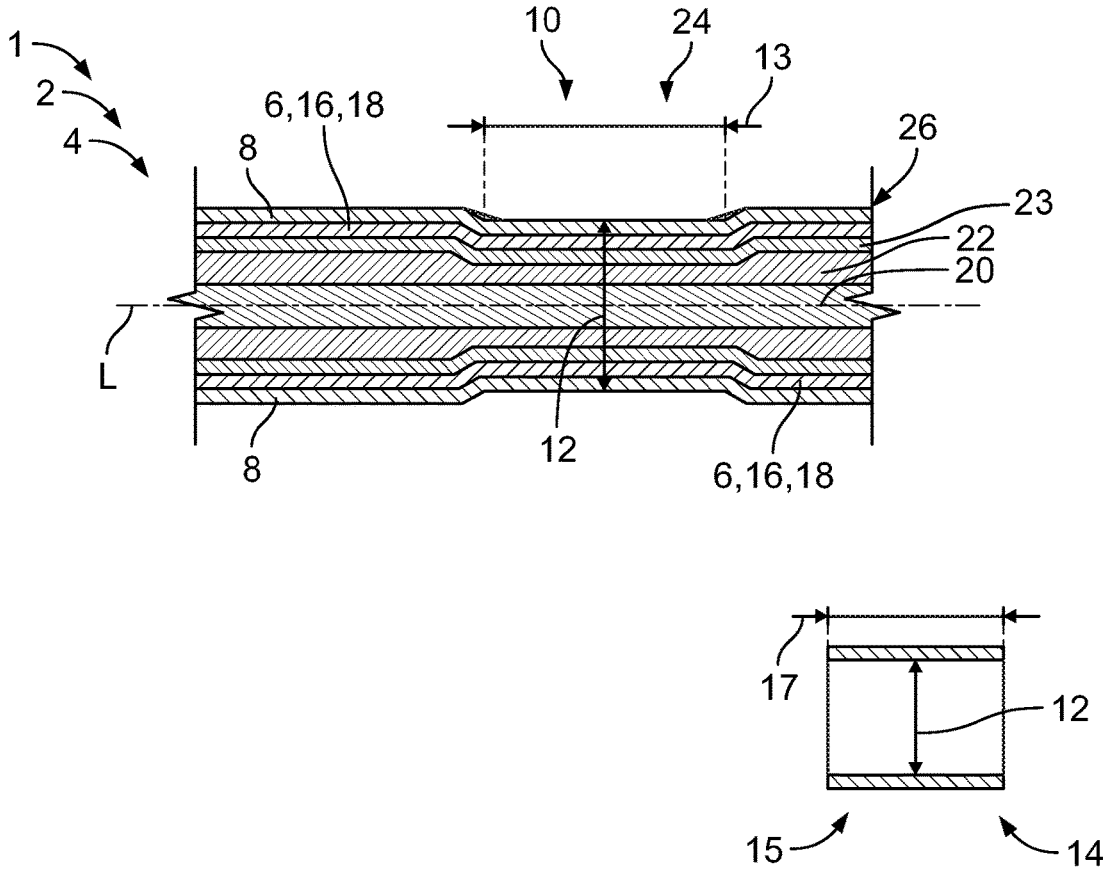
FIG. 1 is a sectional side view of an intermediate product according to an embodiment.

Hereinafter, the invention is described in greater detail by way of example using exemplary embodiments with reference to the attached figures. In the figures, elements which correspond to one another in design and/or function are provided with the same reference numerals. The combination of features shown and described with the individual exemplary embodiments serves solely the purposes of explanation. It is possible to dispense with a feature from an exemplary embodiment if its technical effect is of no importance in a particular application. Conversely, a further feature can be added to an exemplary embodiment if its technical effect is meant to be advantageous or necessary for a particular application.

An intermediate product 1 according to an embodiment is shown in FIG. 1. The intermediate product 1 is for crimping.

As shown in FIG. 1, the intermediate product 1 comprises an electrical conductor 2, which extends along a longitudinal axis L. The electrical conductor 2 can be a standardized network cable 4 in an embodiment. The electrical conductor 2 has a shielding braid 6 and an insulation 8 radially surrounding the shielding braid 6. In a region 10 along the longitudinal axis L, the electrical conductor 2 is radially compressed to a predetermined diameter 12, so that a crimp sleeve 14 can be placed onto the electrical conductor 2 in this region 10 and can be crimped therewith. By compacting the electrical conductor 2 in the region 10, the conductor 2 can be reduced radially to the predetermined diameter 12 and in particular unified, so that individual strands of the shielding braid 6 do not protrude radially out of the crimp sleeve 14 during crimping.

Figure 2:
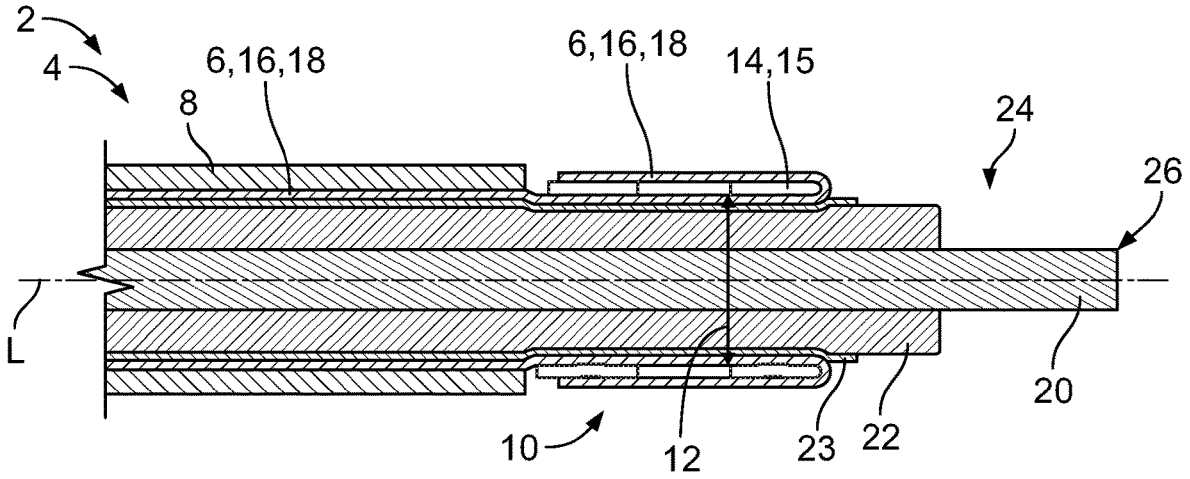
FIG. 2 is a sectional side view of the intermediate product after crimping of a crimp sleeve.

In an embodiment, at least the region 10 with the radial compression can be free from the insulation 8, as shown in FIG. 2, so that the crimp sleeve 14 can be laid directly onto the shielding braid 6. The insulation 8 can be removed from the region 10 in particular after the compacting, so that the insulation 8 serves as a protective sheath during the compacting and the individual strands of the shielding braid 6 are not damaged. In another embodiment, the region 10 with the radially compressed core can be compacted after the stripping; as a result, it is possible to prevent parts of the insulation 8 from getting caught in the shielding braid 6 during the stripping.

The shielding braid 6 can be compressed to the predefined diameter 12 shown in FIGS. 1 and 2, since the crimp sleeve 14 is laid around the shielding braid 6 during the crimping and is crimped therewith. The region 10 can be compressed by ultrasound welding, for example. In particular during the ultrasound welding, an inherently homogeneous core with the smallest possible contact resistance can be created. As an alternative to this or also in addition, the region 10 can also be radially reduced to the predefined diameter 12 by compressing the individual strands.

The shielding braid 6 can be an outer conductor 16, as shown in FIGS. 1 and 2, which is formed from stranded wires 18. During manufacture of the electrical conductor 2, the adjustment to the predefined diameter 12 can be made more difficult in particular on account of the shielding braid 6. In the case of the shielding braid 6, irregularities and high tolerances frequently occur during production, which can lead to problems during the crimping, however, since individual strands, in particular stranded wire cores, can protrude radially out of the crimp sleeve 14.

As shown in FIGS. 1 and 2, the electrical conductor 2 can have at least one inner conductor 20, which can be arranged centrally in the electrical conductor 2 and is surrounded radially by a dielectric 22. A shielding foil 23 can be arranged between the dielectric 22 and the shielding braid 6 to protect the inner conductor 20 from static magnets and/or magnetic alternating fields.

The region 10 can be arranged at a free end 24 of the electrical conductor 2 along the longitudinal axis L. In an embodiment, the region 10 can be spaced apart from a termination 26 at the free end 24 of the electrical conductor 2 along the longitudinal axis L. The region 10 can be spaced apart from the termination 26 along the longitudinal axis L, in an embodiment, at most by a length 17 of a crimp sleeve 14, in particular a support sleeve 15, which is standardized for network cables.

As a result, the shielding braid 6 can be prevented from protruding from the crimp sleeve 14 when it is turned or bent back over the crimp sleeve 14 on the side of the crimp sleeve 14 facing away from the termination 26. In an embodiment, the region 10 with the radially compressed core can be arranged at a spacing of approximately 2 mm to approximately 4 mm from the free end 24 in the longitudinal axis L. The shielding braid 6 surrounds the support sleeve 15 at least partially radially from the outside.

The length 13 of the region 10 along the longitudinal axis L can, in an embodiment, correspond at least to the length 17 of a standardized crimp sleeve 14 for network cables. As a result of the radial compression in the region 10, a seat can be created for the crimp sleeve 14, which seat prevents the crimp sleeve 14 from sliding along the longitudinal axis L relative to the region 10. This leads to a further facilitation of the crimping procedure.

In an embodiment, the region 10 can taper off conically at at least one end of the region 10 along the longitudinal axis L, in particular at both ends of the region 10. As a result, a build-up of material during the stripping at the respective ends of the region 10 can be prevented. The insulation 8 can be stripped off more easily and a stepwise crossover, in which the insulation 8 can get caught, does not form.

The free inner conductor 20 can be crimped with an inner conductor sleeve, before an outer sleeve is crimped with the support sleeve 15 and clamps the section of the shielding braid 6, which is turned over the support sleeve 15, between support sleeve 15 and outer sleeve. The outer sleeve can be configured in such a way that it extends away along the longitudinal axis over L the inner conductor sleeve and surrounds it radially.

A method for crimping the electrical conductor 2 includes the step of compacting the region 10 of the electrical conductor 2 in the radial direction before the crimping. After the crimping of the crimp sleeve 14 in the radially compressed region 10, the shielding braid 6 can be bent back around the crimp sleeve 14 from the free end 24 of the electrical conductor 2 which protrudes along the longitudinal axis L, wherein the bent-back part does not protrude from the shielding braid 6 along the longitudinal axis L over the end of the crimp sleeve 14 facing away from the free end 24 of the electrical conductor 2.

As a result of the intermediate product 1 and the crimping method, errors during manufacture of crimped electrical conductors 2, and the corresponding waste, can be reduced or even prevented. The electrical conductor 2, in particular the shielding braid 6, can be compressed to a substantially uniform and predefined diameter 12 in the region 10 by precompacting, wherein the diameter 12 can be adapted to the respective requirements of the crimp sleeve 14. Furthermore, as a result of the solution according to the invention, a variety of electrical conductors 2 with small differences in diameter can be standardized at least in the region 10, with the result that different electrical conductors 2 can be coupled to identically structured components, for example crimp sleeves 14. The enables a reduction in different components, resulting in further cost savings.

What is claimed is:

1. An intermediate product for crimping, comprising:

an electrical conductor extending along a longitudinal axis, the electrical conductor has a shielding braid and an insulation at least partially enclosing the shielding braid, the electrical conductor has a radially compressed core in a region along the longitudinal axis.

2. The intermediate product of claim 1, wherein the electrical conductor is a network cable.

3. The intermediate product of claim 1, wherein the region is formed at a free end of the electrical conductor.

4. The intermediate product of claim 1, wherein at least one end of the region along the longitudinal axis tapers off conically.

5. The intermediate product of claim 4, wherein each end of the region along the longitudinal axis tapers off conically.

6. The intermediate product of claim 1, wherein the shielding braid is free from the insertion in the region.

7. The intermediate product of claim 1, wherein a length of the region corresponds to a length of a support sleeve along the longitudinal axis.

8. The intermediate product of claim 7, wherein the support sleeve is standardized for a predetermined diameter of the electrical conductor.

9. The intermediate product of claim 8, wherein the support sleeve is crimped to the region.

10. A method for crimping an electrical conductor, comprising:

providing the electrical conductor extending along a longitudinal axis, the electrical conductor has a shielding braid and an insulation at least partially enclosing the shielding braid;

compacting a region of the electrical conductor along the longitudinal axis in a radial direction; and crimping the electrical conductor after the compacting step.

11. The method of claim 10, wherein the electrical conductor is a network cable.

12. The method of claim 10, further comprising stripping the region after the compacting.

13. The method of claim 10, wherein the region is compacted by ultrasound welding.

14. The method of claim 10, wherein the region is compacted by pressing.

* * * * *